US008387312B1

(12) United States Patent
Murrey

(10) Patent No.: US 8,387,312 B1
(45) Date of Patent: Mar. 5, 2013

(54) PLATFORM ARRANGEMENT

(76) Inventor: Gordon Murrey, Torrance, CA (US)

( * ) Notice: Subject to any disclaimer, the term of this patent is extended or adjusted under 35 U.S.C. 154(b) by 526 days.

(21) Appl. No.: 12/655,845

(22) Filed: Jan. 8, 2010

(51) Int. Cl.

| | |
|---|---|
| ***E04H 3/26*** | (2006.01) |
| ***A47F 10/00*** | (2006.01) |
| ***E04B 5/00*** | (2006.01) |
| ***E04B 7/00*** | (2006.01) |
| ***E02D 27/42*** | (2006.01) |
| ***A63D 1/00*** | (2006.01) |

(52) U.S. Cl. ..... 52/7; 52/36.1; 52/263; 52/299; 473/115

(58) Field of Classification Search ..... 52/677, 52/7, 292, 299, 686, 6, 36.1, 274, 656.1, 52/638, 263; 248/581, 678, 346.01; 473/115, 473/117; 446/85, 106, 108, 111, 124, 127
See application file for complete search history.

(56) References Cited

U.S. PATENT DOCUMENTS

| | | | | |
|---|---|---|---|---|
| 1,710,610 | A | 4/1929 | Duke | |
| 2,686,054 | A * | 8/1954 | Coroniti | 473/115 |
| 3,045,294 | A | 7/1962 | Livezey, Jr. | 20/8 |
| 3,477,719 | A | 11/1969 | Szymanski | 273/51 |
| 4,330,122 | A | 5/1982 | Sheinberg et al. | 273/51 |
| 4,538,392 | A | 9/1985 | Hamar et al. | 52/582 |
| 4,811,530 | A * | 3/1989 | Eyerly | 52/6 |
| 5,121,579 | A | 6/1992 | Hamar et al. | 52/585 |
| 5,667,444 | A | 9/1997 | Caballero | 472/92 |
| 5,675,950 | A * | 10/1997 | Schilham | 52/263 |
| 5,820,470 | A | 10/1998 | Saunders | 472/90 |
| 6,032,425 | A | 3/2000 | Gugliotti et al. | 52/480 |
| 6,032,427 | A | 3/2000 | Randjelovic | 52/584.1 |
| 6,173,548 | B1 | 1/2001 | Hamar et al. | 52/582.1 |
| 6,189,283 | B1 | 2/2001 | Bentlet et al. | 52/587.1 |
| 6,345,474 | B1 * | 2/2002 | Triplett | 52/169.9 |
| 6,684,592 | B2 | 2/2004 | Martin | 52/591.5 |
| 6,851,234 | B2 * | 2/2005 | Hoffman et al. | 52/299 |
| 7,022,024 | B2 * | 4/2006 | Brim et al. | 473/115 |
| RE39,097 | E * | 5/2006 | Schilham | 52/263 |
| 7,587,865 | B2 | 9/2009 | Muller, Jr. | 52/181 |
| 2005/0144880 | A1 | 7/2005 | Bengry et al. | 52/578 |
| 2007/0062147 | A1 | 3/2007 | Wright | 52/582.1 |
| 2009/0071084 | A1 | 3/2009 | Johansson | 52/263 |
| 2009/0151283 | A1 | 6/2009 | Gleeson et al. | 52/309 |

OTHER PUBLICATIONS

Sanay (Russia) Robbins Horner GAI Sports Floors, 2005.
Connor O'Mara Universal Floor Score, 2005.

* cited by examiner

*Primary Examiner* — Andrew Triggs
(74) *Attorney, Agent, or Firm* — Don Finkelstein

(57) ABSTRACT

A removable platform for covering bowling alley lanes to provide a flat surface above the lanes suitable for a variety of other activities.

18 Claims, 10 Drawing Sheets

PLATFORM ARRANGEMENT

BACKGROUND OF THE INVENTION

1. Field of the Invention

This invention relates to the platform art and more particularly to a removable platform installable over a bowling alley array to allow the bowling alley facility to be utilized for functions other than bowling.

2. Description of the Prior Art

There are many applications in which a facility may be utilized for various and different functions and in which the floor may consist of a function specific configuration. For example, many indoor sports arenas are utilized for both basketball and ice hockey. In such arenas, a removable basketball floor, often of a parquet configuration, is placed over the floor which, when flooded with water and frozen, is utilized for ice hockey. Many configurations of such removable flooring for such uses have been proposed and/or are available for use. Such systems provide for greater utilization of the facility and thus are economically attractive to the owners of the facilities.

However, there is one form of a sports arena that often has a very much greater area than the conventional basketball/ice hockey facility and in which the floor level utilized for the primary function is not substantively coplanar. One such sports facility is the bowling alley facility in which a plurality of side by side parallel bowling lanes are provided for use during bowling. The number of such lanes in any one facility may be forty-eight, sixty or even greater. All of the bowling surfaces of the plurality of lanes upon which bowling balls are rolled are generally fabricated from a preselected wood or plastic laminate and are substantially coplanar. The bowling surfaces are flat and are carefully maintained free from dents, protrusions or other types of defects which would affect the trajectory of a bowling ball rolled thereon. The lanes extend longitudinally from an approach area upon which the bowler approaches the lanes and launches the bowling ball onto the bowling lane to the bowling pin/ball chamber area at the remote end of each lane. As is standard in present day bowling alleys, the pins are generally automatically "spotted" by the pin setting mechanisms into prescribed configurations depending on whether it is the first ball of a line or the second ball of line. If the first ball of a line does not knock all the pins down, the pins are set for the second ball into the configuration left after the first ball. After the second ball of each line, the pins are set to the initial configuration for the first ball of each line. The bowling pin/ball chamber area also contains the mechanism for receiving the bowling ball after each bowling thereof and directing the bowling ball into a ball return portion which directs the bowling ball longitudinally back from the bowling pin/ball chamber at the remote end of the lane to a region in the approach area so that the ball may be repeatedly utilized.

Each lane in the plurality of lanes is provided with gutters extending longitudinally at each edge of the lane and each gutter has a generally semi circular configuration extending below the bowling surface level of the lanes. A first of the two gutters of each lane is separated from a first of the two gutters of an adjacent lane on one side of the alley by a single division capping having a first preselected transverse width which extends vertically a first preselected height above the bowling surface of the lanes. The second of the two gutters of each lane are separated from the gutters of an adjacent lane on the other side of the lane by a ball return capping which has a second preselected transverse width that is wider than the first preselected transverse width of the single division capping and the ball return capping extends vertically above the surface level of the bowling lanes a second preselected height which may be greater than the first preselected height of the single division capping.

The proprietors of many bowling alley facilities often desire to convert, temporarily, the array of bowling alley lanes to a continuous, flat, platform surface suitable for conducting meetings, dances, political rallies and the like, or other sports activities such as badminton, team handball, volleyball or other desired sports activities. However, removable platforms utilized in other applications cannot be utilized to convert a bowling alley facility to a continuos level flat, level platform surface because of the variations in height of the various portions of the bowling lanes such as the differences in height of the bowling surface, gutters, single division capping and ball return cover capping. There is also the requirement that the there be no damage to the bowling surface of each lane during the installation, removal or use of the platform. The platform covering for a bowling alley array also must be easily assembled on the bowling alley array, easily removed from the bowling alley array. It is desired that such a removable platform also be of a modular type configuration to facilitate the handling, shipping and storage of the components thereof. Since the area of a typical bowling alley facility is much larger than the area of other sports facilities utilizing removable platform like coverings, it is also desired that the components of the platform should be conveniently storable and, to minimize cost to the bowling alley facility proprietor, should utilize as components materials that are generally locally obtainable.

Thus, there has long been a need for a removable platform providing a flat, level surface for converting an array of bowling alley lanes into a flat, level platform which can accommodate a variety of other activities, be easily assembled, installed and removed from the bowling alley array, not harm or damage the bowling surface of the alleys during use, installation or removal, be conveniently storable, utilize readily obtainable local supplies for components of the platform, and be economical to fabricate, ship and store. The removable platform is also desired to be easily manipulated during installing, removal, storing maintained in condition during storage so that it may be readily used repetitively as a platform.

Accordingly, it is an object of the present invention to provide an improved removable platform for a bowling alley array in a bowling alley facility.

It is another object of the present invention to provide an improved removable platform for a bowling alley array in a bowling alley facility that is easily assembled, installed on and removed from the bowling alleys.

It is another object of the present invention to provide an improved removable platform for a bowling alley array in a bowling alley facility that does not damage or injure the bowling surface of the bowling alleys during installation thereon, utilization for other desired activities and removal.

It is another object of the present invention to provide an improved removable platform for a bowling alley array in a bowling alley facility wherein some of the components may be fabricated from readily available local sources.

It is yet another object of the present invention to provide an improved removable platform for a bowling alley array in a bowling alley facility that can be relatively economically fabricated, shipped. and stored when not in use.

SUMMARY OF THE INVENTION

The above and other objects of the present invention are achieved, in a preferred embodiment thereof, by a platform arrangement for covering a plurality of bowling lanes of a bowling alley facility which lanes are in a transverse array. The bowling alley array has a plurality of longitudinally extending bowling lanes in a side by side substantially parallel alignment. Each of the bowling lanes has a bowling surface upon which the bowling ball is launched from an approach area towards the remote end of the lane which has the pin deck and ball return mechanism. There are bowling ball gutters extending longitudinally adjacent each side of each of each of the bowling lanes. The gutter adjacent a first edge of each lane is separated from the gutter in the adjacent lane by a single division capping and the gutter adjacent the second edge on the other side of each is separated from the gutter on the adjacent lane by a ball return cover capping. Both the ball return cover capping and the single division capping extend vertically above the level of the bowing surface of the lanes. The ball return cover capping is much wider than the single division capping. The gutters are in a close proximity where separated by the single division capping and in a larger separation where separated by the ball return cover capping. The single division capping generally extend vertically above the bowling surface of the alleys a first preselected height and the ball return cover capping extends vertically above the bowling surface of the lane a second preselected height which generally may be the same or greater than the first preselected height.

The removable platform of the present invention provides a unique platform arrangement covering for utilization over a bowling alley facility as above described. The platform arrangement has a plurality of base support members in a preselected rectilinear grid having a preselected longitudinally extending spaced array along the longitudinal extent of the bowling alley lanes from the approach area to the pin deck area and the plurality of base support member are in a substantially aligned transverse array of the adjacent bowling lanes of the bowling alley array. Each of the base support members have a top surface and a bottom surface, and the bottom surface is adapted to be in contact with the bowling surface of the bowling lanes to support the platform thereon and the base support members are free of contact with any other portions of the bowling alley array. Each of the base support members has a front surface facing towards the approach area and a back surface spaced longitudinally from the front surface and facing the pin deck area. Each of the base support members has a first end surface and a second end surface transversely spaced from the first end surface. The transverse width of each of the base support members is slightly greater than the transverse width of the bowling surface of the lane so that the ends overhang the gutters at each side of the bowling lanes. The ends of transversely aligned base support members at the single division capping are spaced in a relatively close proximity to each but not touching each other or touching or over hanging the single division capping. The ends of transversely aligned base support members at the ball return cover capping are in a greater spaced proximity to each other but not touching each other or touching the ball return cover capping.

In preferred embodiments of the present invention, the base support members are fabricated from rotational molding of a linear low-density polyethylene as this has been found to provide both support for the platform but not mar or damage the bowling surface. Other materials may be utilized for the base support members in particular applications as long as such materials are suitable for the purpose in providing adequate support for the platform but not mar or damage the bowling surface of the lane.

The top surface of each of the base support members has first walls defining a transversely extending groove therein extending from the first end to the second end and the transversely extending grooves in each base support member are in transversely aligned relationship with adjacent transverse base support members. The front surface of each of the plurality of base support members has second walls defining a plurality of front pockets in a preselected front pocket transversely spaced array. The back surface of each of the plurality of base support members has third walls defining a plurality of back pockets in a preselected back pocket transversely spaced array. In preferred embodiments of the present invention, the front pocket transversely spaced array is substantially the same as the back pocket transversely spaced array so that pockets are longitudinally aligned and the number of the plurality of second walls in the front surface of each of the base support members is the same as the number of third walls in the back surface of each of the base support members.

Each of the front pockets and each of the back pockets has an open top at the top surface of each of the base support members. Each of the front pockets and each of the back pockets have an inner wall surface, spaced apart side wall surfaces and a lower wall surface, the lower wall surface is spaced intermediate the top surface and the bottom surface of the base support members. At least some of the lower wall surfaces of the second and the third walls have protrusion accepting depressions therein.

In preferred embodiments of the present invention the front surface and the back surface of each of the base support members are angled from the vertical from a wider bottom surface to a narrower top surface.

The platform of the present invention also has a plurality of transverse cross members positionable in the transversely extending groves in the top surface of the plurality of base support members and the plurality of transverse cross members extending between transversely aligned base support members in adjacent lanes and bridging over and free of contact with the bowling ball return cover capping and bridging over and free of contact with the single division capping. The plurality of transverse cross members may be conventional, readily available lumber such as a 2×4 floor joist or other size as desired for particular applications. The size of the transversely extending groove in the top surface of each of the base support members is selected to accommodate the size of the transverse support members.

A plurality of longitudinal support members are provided to extend between the longitudinally spaced apart base support members and are positioned in the front pockets of each base support member and the back pockets of the next longitudinally spaced base support member. The longitudinal support members may be conventional readily available lumber such as a 2×4 floor joist lumber though other sizes may be utilized as desired for particular applications. The size of the front pockets and the back pockets are selected to accommodate the selected size of the longitudinal support members.

In some applications it may be desired to have at least some longitudinal support members be fabricated to have a bottom surface that contacts the bowling surface of the lane for additional support of the platform on the bowling surface of the lanes. In order to prevent damage to the surface of the lane, the lane edge longitudinal support members have end shoulders that fit into the front and back pockets of the base support members adjacent to the lane edges and have a bottom surface for engaging the bowling surface of the lane, a top surface spaced from the bottom surface and substantially coplanar with the top surface of the base support members. The lane edge longitudinal support members may be fabricated from the same linear low-density polyethylene material as the base support members.

The platform is completed by installing a planar sheet like member on the top surface of the plurality of base support members, on top of the lane edge longitudinal support members, on top of the longitudinal support members and the transverse support members so as to link them together to form a solid platform arrangement. The sheet like members extend over a first preselected number of the plurality of the longitudinally extending spaced array of the base support members and a second preselected number of the substantially aligned transverse array of the base support members so that they link together these members from adjacent lanes. The sheet like member may be a conventional readily available four foot by eight foot sheet of plywood resting on the top surfaces of the base support members, the transverse support members, the longitudinal support members and the fabricated support members. Some of the sheet like members may be cut as required to fit the configuration of the platform in those applications where the dimensions of the platform are not multiples of four foot by eight foot.

Some of the longitudinal support members and some of the lane edge longitudinal support members may have protrusions on the bottom surfaces for engagement with the protrusion accepting apertures in the base wall of the front and back pockets of the base support members. Additionally, the front and back surfaces of the lane edge longitudinal support members may have a matching pattern of protuberances and protuberance accepting apertures to allow convenient storage thereof.

The base support members may also be provided with hand rail support accepting apertures in regions adjacent the end surfaces thereof so that a hand rail assembly may be installed around some or all of the platform

BRIEF DESCRIPTION OF THE DRAWING

The above and other embodiments of the present invention my be more fully understood from the following detailed description taken together with the accompanying drawing wherein similar reference characters refer to similar elements throughout and in which.

DESCRIPTION OF THE PREFERRED EMBODIMENTS

Figure 1:
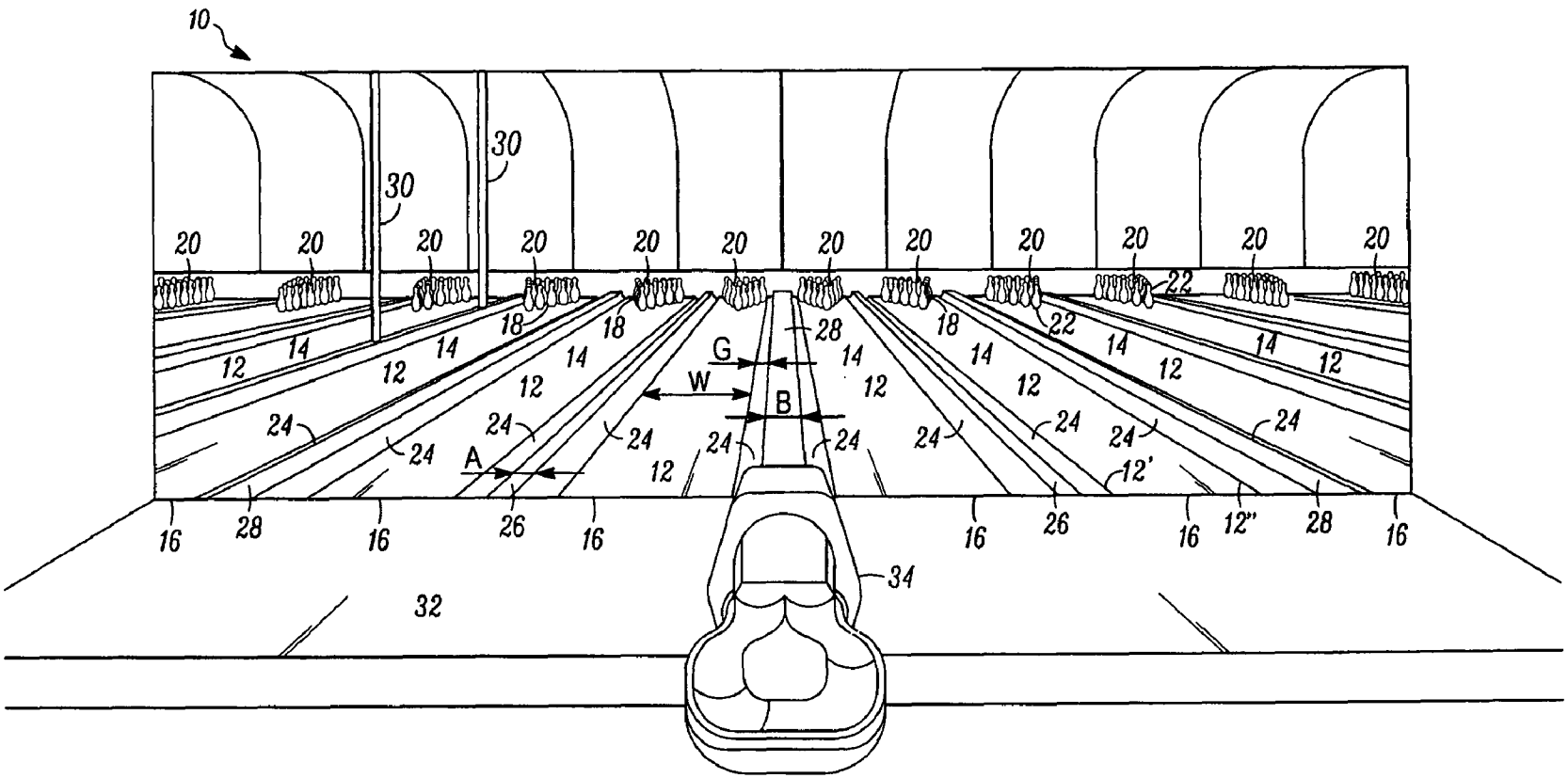
FIG. 1 is a perspective view of a bowling alley facility showing a plurality of bowling lanes which may be covered by the removable platform arrangement of the present invention.
Figure 2:
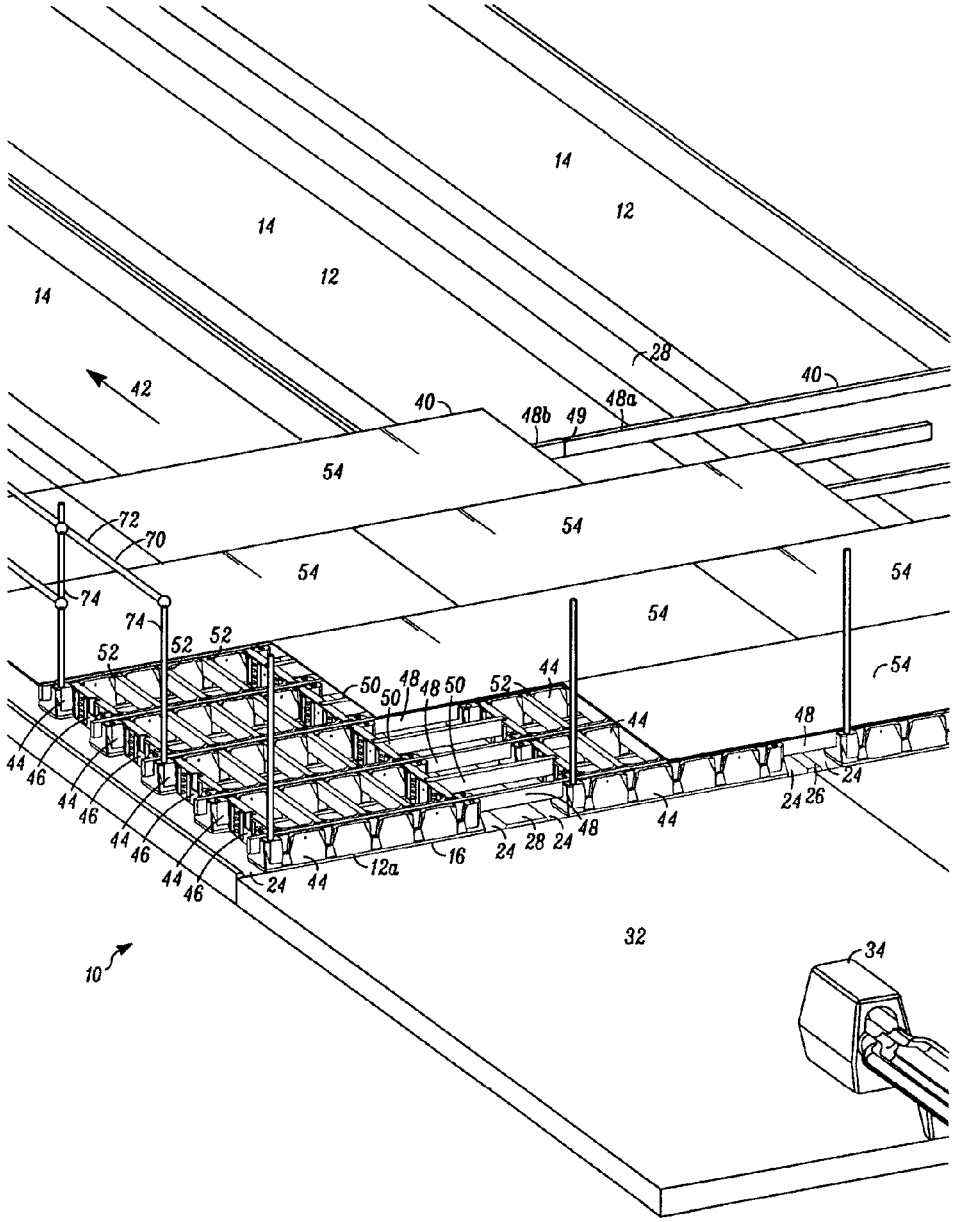
FIG. 2 is a partial perspective view of a removable platform according to the principles of the present invention as installed over the lanes of a bowling alley facility.
Figure 3:
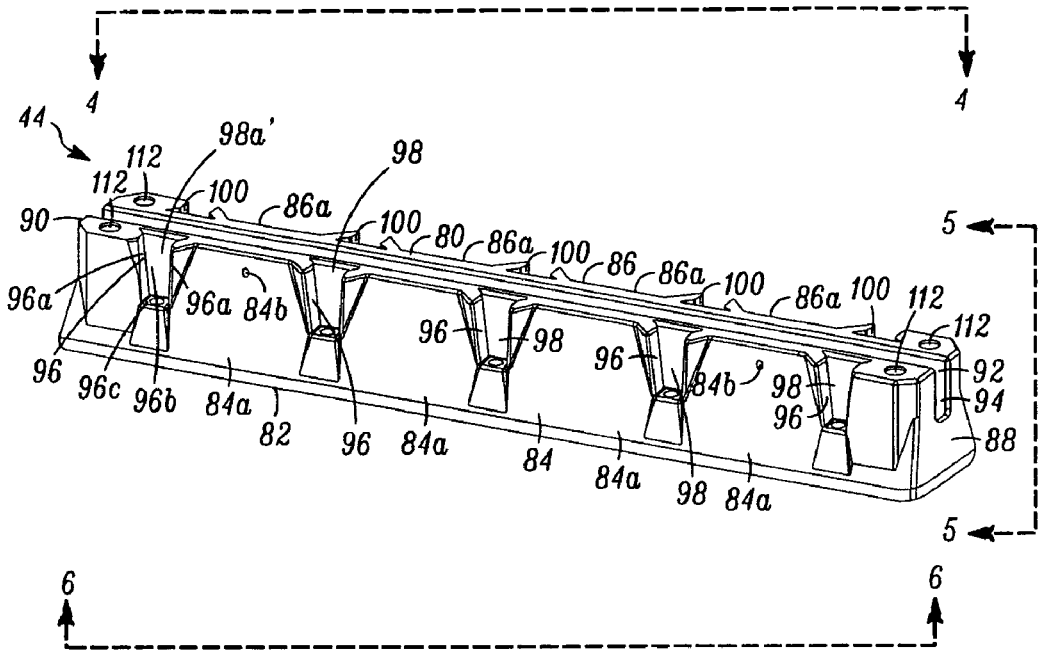
FIG. 3 is a perspective view of a preferred embodiment of a base support member useful in the practice of the present invention.
Figure 4:
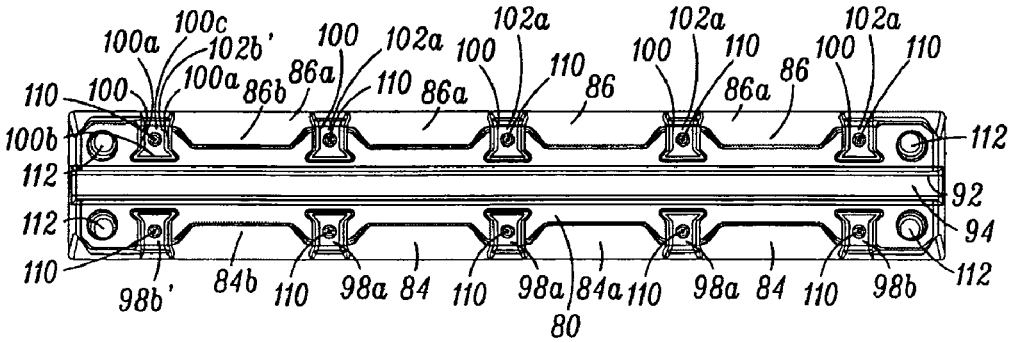
FIG. 4 is a top view of the preferred embodiment of a base support member useful in the practice of the present invention.
Figure 5:
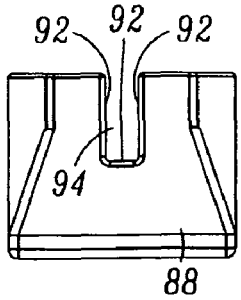
FIG. 5 is an end view of the preferred embodiment of the base support member useful in the practice of the present invention.
Figure 6:
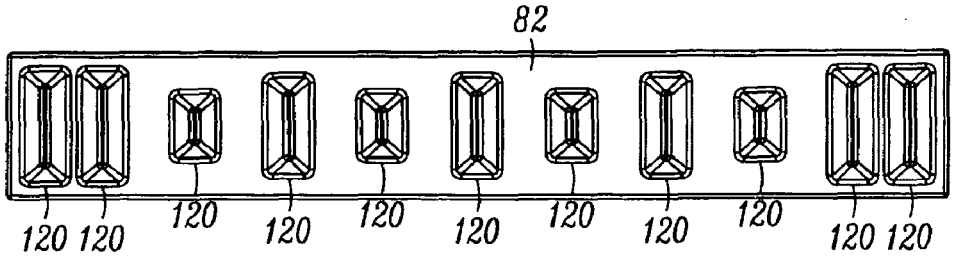
FIG. 6 is a bottom view of the preferred embodiment of the base support member useful in the practice of the present invention.

Referring now to the drawing, there is illustrated in FIG. 1 is perspective views of a bowling alley facility generally designated 10 having a plurality of side by side parallel bowling lanes 12 on which The number of such lanes 12 may be, for example, two to 48, or more in any one bowling alley facility 10. Each of the lanes 12 has a bowling surface 14 extending longitudinally from a foul line 16 to a pin deck area 18 and, in playing the game of bowling, a bowling ball is rolled along the bowling surface towards the pins 20 at the pin deck. The bowling pins 20 are set in the desired array at the pin deck 18 and the setting of the pins is generally done by an automatic pin setter mechanism. Adjacent to the pin deck area there is a ball return mechanism which directs the bowling ball into a return mechanism (not shown in FIG. 1 and which is not part of the present invention) in the direction of the foul line 16.

Each of the bowling surfaces 14 of the lanes 12 are substantially level and coplanar and are maintained in a smooth condition free of protuberances, depressions, grooves, ridges or the like which would affect the course of a bowling ball rolled on the bowling surface 14. The longitudinal length of each of the lanes 12 is generally 60 feet from the foul line 16 to the center of the location of the number one pin 22 at the pin deck area 16. Each of the lanes 12 has a transverse width indicated at W of 42 inches and the edges 12' and 12" of each of the lanes 12 are bounded by a gutter 24 extending below the bowling surface 14 of the lanes 12 and each of the gutters has a width G of nine inches. The dimensions as above stated are the nominal dimensions as specified by the ABC and WIBC bowling organizations. As shown on FIG. 1, alternate gutters 24 of adjacent lanes 12 are separated by a single division capping 26 and a ball return capping 28. The single division capping 26 and the ball return cover capping 28 extend vertically above the level of the bowling surface 14 of the lanes 12. The transverse width single division capping as indicated at A may be on the order of 2¾ inches and the transverse with of the ball return cover capping 28 as indicated at B may be on the order of 9 to 10½ inches, which are not ABC specified dimensions but are an accepted in the bowling alley industry as standard dimensions.

Some bowling alley facilities 10 may require columns to support the roof of the bowling alley facility. As shown in FIG. 1 columns as indicated at 30 may be present between lanes 12 at desired or required locations. The columns 30 do not interfere with the function of the bowling alley facility 10.

An approach area 32 extending transversely adjacent to the lanes 12 and extending longitudinally away from the foul line 16 opposite to the direction of the lanes 12 is also provided in the bowling alley facility 10.

A ball return hood and rack 34 is provided on the approach area 32 and spaced from the foul line 16. The ball return hood and rack are aligned with each of the ball return cover cappings and receive the bowling balls as moved from regions behind the pin deck area 18 under the ball return cover cappings for repetitive utilization as desired.

The above description of a typical bowling alley facility 10 is provided so that the following detailed description of the configuration of a removable platform, according to the principles of the present invention, to be installed above the bowling alley lanes 12 may be more readily understood. The removable platform of the present invention is installed over the lanes 12 and in preferred embodiments of the present invention the removable platform extends from regions adjacent the foul line 16 to regions adjacent the pin deck area 18.

Referring to FIGS. 2, 11, 12, 13 and 14 there is shown thereon partial perspective views of a portion of a bowling facility 10 having a removable platform 40 according to the principles of the present invention and in which portions of the top sheet like members thereof are omitted for clarity. The removable platform 40 extends longitudinally from regions adjacent the foul line 16 towards the pin deck area (not shown on FIG. 2) as indicated by the arrow 42. for clarity, only a portion of the removable platform 40 is shown on FIG. 2 and only a few of the lanes 12 of the bowling facility 10 are shown on FIG. 2. Most bowling facilities 10 have the lanes 12 beginning with a left hand lane as indicated at lane 12*a* and have bowling surfaces 14. A plurality of base support members 44 are positioned in a rectilinear grid along the lanes 12 and are in a spaced apart longitudinal array on each lane 12 and in an aligned transverse array between adjacent lanes 12. The longitudinal spacing of the base support members 44 may be on the order of 24 inches though greater or less spacing may be utilized as required for particular applications.

A plurality of lane edge longitudinal support members 46 are positioned adjacent the edges of each of the lanes 12 and extend between the base support members 44. According to the principles of the present invention, only the bottom surfaces of the base support member 44 and the bottom surfaces of the lane edge longitudinal support members 46 are in contact with any portion of the bowling alley facility and these surfaces contact only the bowling surface of the lanes 12 though in some applications the surface of the approach area 32 may also be contacted.

A plurality of transverse support members 48 are positioned on the base support members 44 and extend between aligned base support members 44 on adjacent alleys. The transverse support members 48 extend over the gutters 24, over the single division capping 26, over the gutters 24 and over the ball return capping 28 without any contact therewith.

A plurality of auxiliary transverse support members 50 extend between the aligned lane edge support members 50 and pass over the single division capping 26 and over the ball return capping 28 and over the gutters 24 without contact therewith. As noted above, only the bottom surface of the base support members 44 and the bottom surface of the lane edge longitudinal support members 46 are in contact with the bowling surface 14 of the lanes 12 for support of the platform 40 thereon. The transverse support members 48 may have a length that does not extend over as many lanes 12 as desired. As such, in preferred embodiments of the present invention the ends of aligned support members are positioned over the bowling surface 14 of a lane 12 as indicated at 49.

Depending upon the longitudinal spacing of the base support members 44, in some applications of the present invention it may be found that auxiliary transverse support members 50 may not be required for full support of the sheet like members 54 and the anticipated loading thereon when the removable platform 40 is used for its intended purpose.

A plurality longitudinal support members 52 extend between the base support members 44. In preferred embodiments of the present invention, the top surfaces of the base support members 44, lane edge support members 46, the transverse support members 48, the auxiliary transverse support members 50, and the longitudinal support members 52 are all coplanar for support of a plurality of sheet like members 54. The sheet like members may be conventional four foot by eight foot sheets of plywood and may, if desired for particular applications have the upper surface thereof treated and/or provided with appropriate surface coatings or cover material as desired for particular applications of the intended use of the platform 40.

The transverse support members 48, the auxiliary transverse support members 50, and the longitudinal support members 52 may be conventional 2×4 lumber or other sizes of conventional lumber. The use of conventional size lumber readily available at lumber yards across the country and in proximity to bowling alley facilities results in a more economical removable platform 40 since such components may be purchased by the bowling alley proprietor locally and would not have to be shipped from a central manufacturing facility.

As described below in greater detail, the finished removable platform 40 may be provided with a rail system indicated at 70 having a hand rail 72 and a plurality of uprights 74 for supporting the hand rail 70 arranged along the periphery of the removable platform 40.

FIGS. 3, 4, 5 and 6 illustrate a preferred embodiment of a base support member 44 useful in the practice of the present invention. The base support member 44 has a top surface 80, a bottom surface 82, front surface 84 and a back surface 86 which is spaced longitudinally from the front surface 84, a first end surface 88 and a second end surface 90 spaced transversely from the first end surface 88. The front surface 84 and the back surface 86 have major portions thereof as indicated at 84*a* and 86*a* which are tapered from a wider portion at the bottom surface 82 to a narrower portion at the top surface 80. The base support members may have a transverse length between the first end surface 88 and the second end surface 90 on the order of 50 inches so that the first end surface 80 and second end surface 90 overhang the gutters 24 but there is no contact with the gutters or with the end surfaces of a transversely aligned base support members 44.

The top surface 80 of the base support members 44 has first walls 92 defining a transversely extending groove 94 extending from the first end 88 to the second end 90. The groove 94 is configured to accept the transverse support members 52. The front surface 84 has a plurality of second walls 96 defining plurality of transversely spaced apart front pockets 98. As shown most clearly on FIG. 4, there are first portion of the plurality of transversely spaced apart front pockets 98*a* and a second portion of the plurality of transversely spaced apart front pockets 98*b*. The second portion of the plurality of transversely spaced apart front pockets 98*b* are in regions adjacent the first and second end surfaces 88 and 90.

The back surface 86 has a plurality third walls 100 defining plurality of transversely spaced apart back pockets 102. As shown most clearly on FIG. 4, there is a first portion of the plurality of transversely spaced apart back pockets 102*a* and a second portion of the plurality of transversely spaced apart back pockets 102*b*. The second portion of the plurality of transversely spaced apart back pockets 102*b* are in regions adjacent the first and second end surfaces 88 and 90.

The front pockets 98*a* are longitudinally aligned with the back pockets 102*a* and the front pockets 98*b* are longitudinally aligned with the back pockets 102*b*. The front pockets

98*a* and the back pockets 102*a* are configured to accept the longitudinal support members 52 and the front pockets 98*b* and the back pockets 102*b* are configured to accept the lane edge support members 46, as described below. Each of the front pockets 98*a* and 98*b* are similarly configured and have an open top and the second walls 96 have a pair of side wall portions 96*a*, a back wall portion 96*b* and a bottom wall portion 96*c* as indicated at front pocket 98*b*'. Each of the back pockets 102*a* and 102*b* are similarly configured and the third walls 100 have side wall portions 100*a*, a back wall portion 100*b* and a bottom wall portion 100*c* as indicated a back pocket 102*b*'.

In preferred embodiments of the present invention the bottom walls 96*c* and 100*c* have protrusion accepting depressions 110 therein for accepting protrusions as provided on the longitudinal support members 52 and the lane edge support members 46.

A plurality of apertures 112 are provided in the upper surface 80 of the base support members 44 in regions adjacent the ends 88 and 90 for receiving the uprights 74 of the rail system 70.

The base support members 44 may be provided with a plurality of walls 120 (FIG. 6) tapered inwardly and extending from the bottom surface 82 towards the top surface 80 to provide additional load support. Such walls are called "kiss offs" and enhance the load bearing capability of the base support members 44.

In order to provide additional support between the base support members 44 and the transverse support members 48, the base support members 44 may be provided with apertures 84*b* in front wall 84 and 86*b* in back wall 86 extending into the groove 94 to allow insertion of a screw or other attaching member into the transverse support member 48.

It has been found that linear low density polyethylene may be advantageously utilized as the material from which the base support members 44 are fabricated. This material is described in detail in Wikipedia, the free encyclopedia as set forth in the Internet site thereof in the section "Linear Low Density Polyethylene" and the teaching and technology thereof is incorporated herein by reference. Such material combines the strength necessary to support the removable platform 40 but also will not mar, dent, scratch or in any way damage the bowling surfaces 14 of the lanes 12. However, other materials having similar characteristics may also be utilized as desired in particular applications. The linear low density polyethylene may be economically molded into the desired configuration of the base support members 44 by a rotational molding technique.

FIGS. 7, 8, 9 and 10 illustrate a lane edge longitudinal support member 46 useful in the practice of the present invention. The lane edge longitudinal support members 46 has a top surface 138, a bottom surface 140, a front surface 142 and a back surface 144. The lane edge longitudinal support member 46 has a first end surface 146 and a second end surface 148. The first end surface has a shoulder portion 150 and the second end surface 148 has a shoulder portion 152. The shoulder portions 150 and 152 are configured to fit into the front pockets 98*b* and back pockets 102*b* of the base support members 44.

The lane edge longitudinal support member 46 has fifth walls 154 defining a front wall pocket 156 which is configured to accept the transverse support members 50, which, as noted above, may be a conventional 2×4 lumber. As installed in the removable platform 40 as shown most clearly in FIGS. 11, 12, 13 and 14, the lane edge longitudinal support members are positioned to have the front surface 142 of one lane edge longitudinal support member 46 facing the front surface 142 of a lane edge longitudinal support member 46 on an adjacent lane so that the auxiliary transverse support members 50 bridge both the ball return cover capping 28 and the and the single division capping 26. The wall fifth walls 154 have side wall portions 154*a*, a back wall portion 154*b* and a bottom wall portion 156*c* and an open top. The bottom surface 140 of the lane edge longitudinal support member 46 contacts the bowling surface 14 of the lanes 12.

A plurality of "kiss off" apertures 160 may be provided in the lane edge longitudinal support member 46 and extend from the front surface 140 toward the back surface 144 for structural support. The lane edge longitudinal support members 46 may also be fabricated from linear low density polyethylene and manufactured by rotational molding as described above for the base support members 44.

Figure 7:
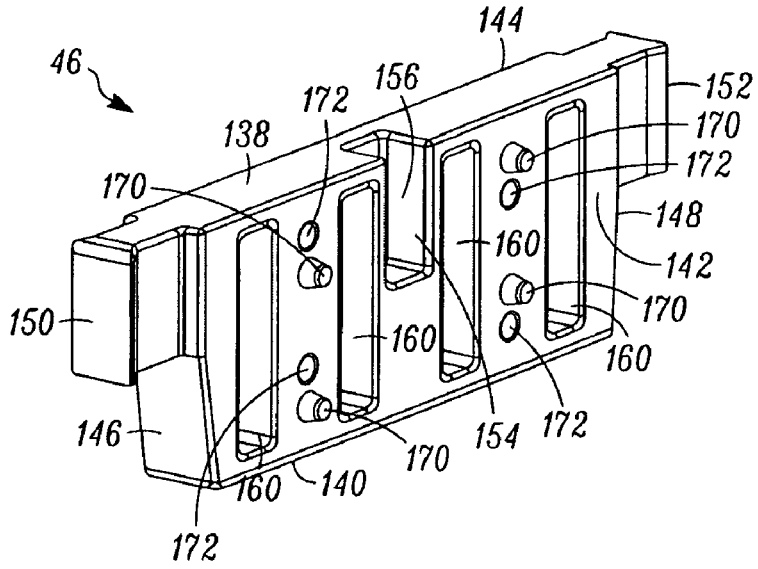
FIG. 7 is a perspective view of a preferred embodiment of a lane edge support member useful in the practice of the present invention.
Figure 8:
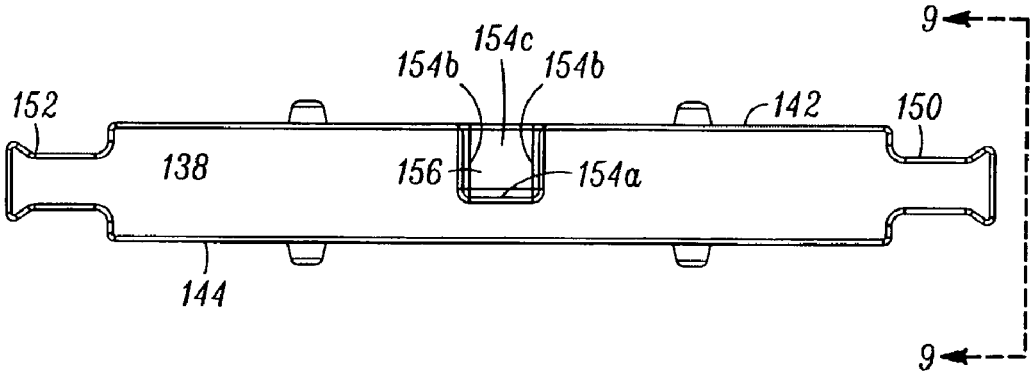
FIG. 8 is a top view of the preferred embodiment of a lane edge support member useful in the practice of the present invention.

For convenience in shipping and storing, the lane edge longitudinal support member 46 may be provided with a plurality of protuberances 170 which are designed to fit into the apertures 172 in the arrangement shown on FIG. 7 when face surfaces 142 are placed together and back surfaces 144 are placed together.

Figure 9:
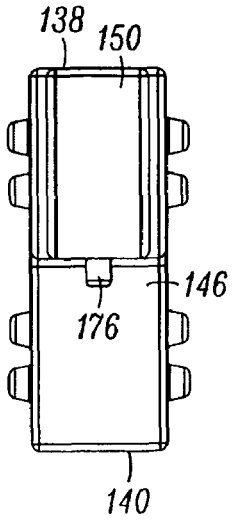
FIG. 9 is an end view of the preferred embodiment of the lane edge support member useful in the practice of the present invention.
Figure 10:
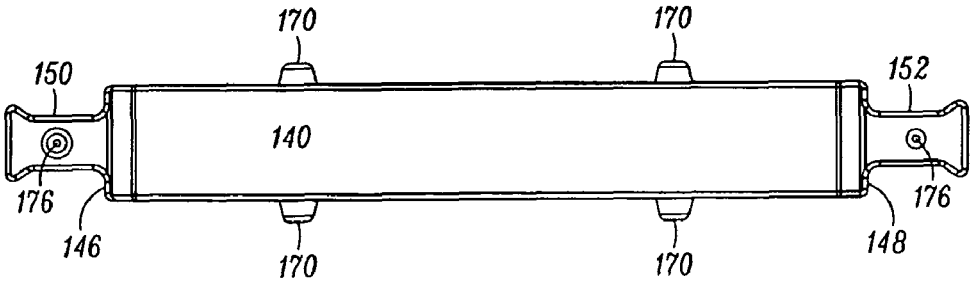
FIG. 10 is a bottom view of the preferred embodiment of the lane edge support member useful in the practice of the present invention; and, FIGS. 11, 12, 13 and 14 are similar to FIG. 2 and are partial perspective views illustrating details of an assembled removable platform as installed over the lanes of a bowling alley
Figure 11:
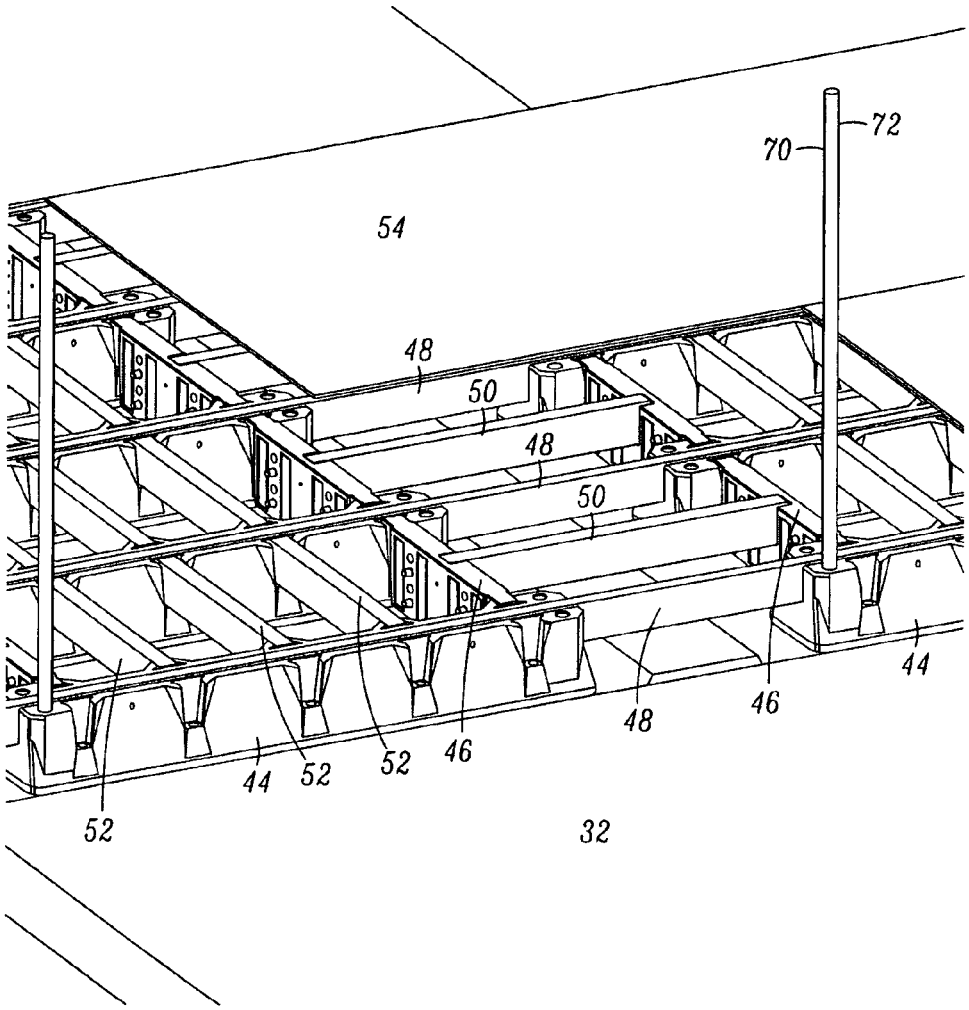
Figure 12:
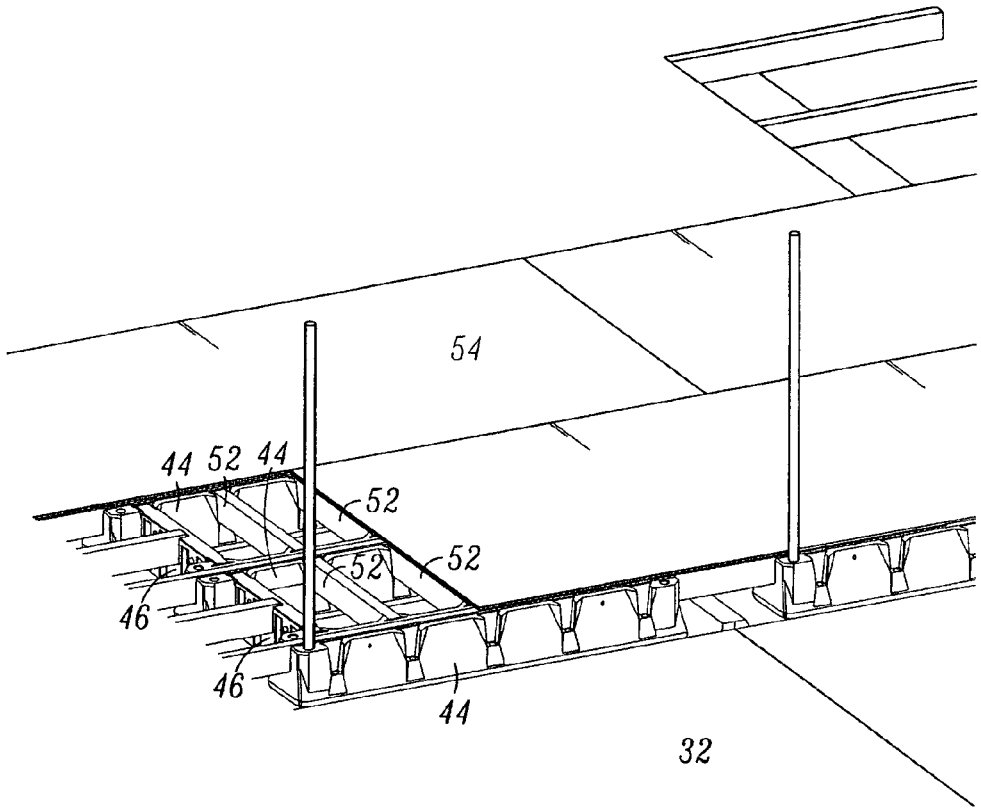
Figure 12:
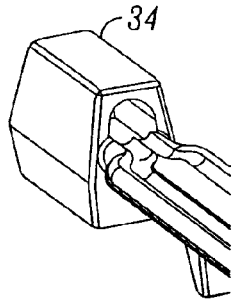
Figure 13:
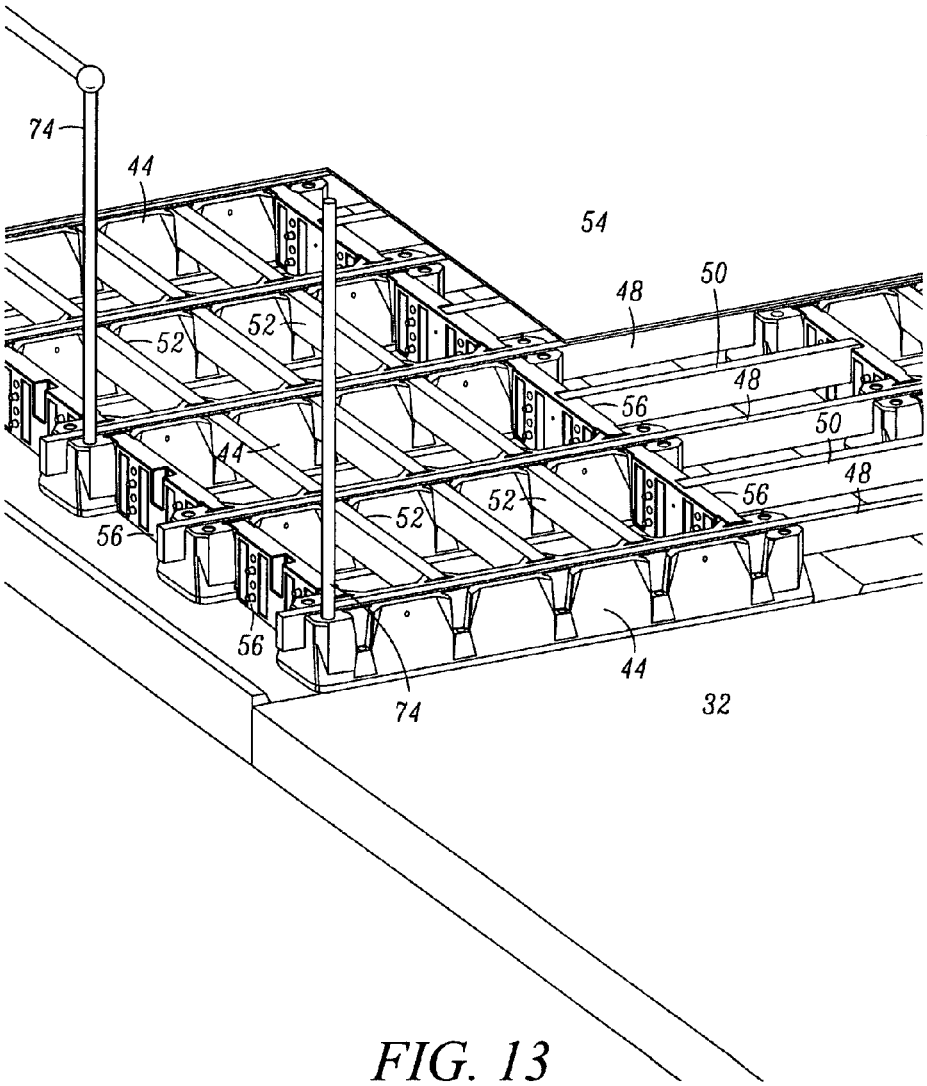
Figure 14:
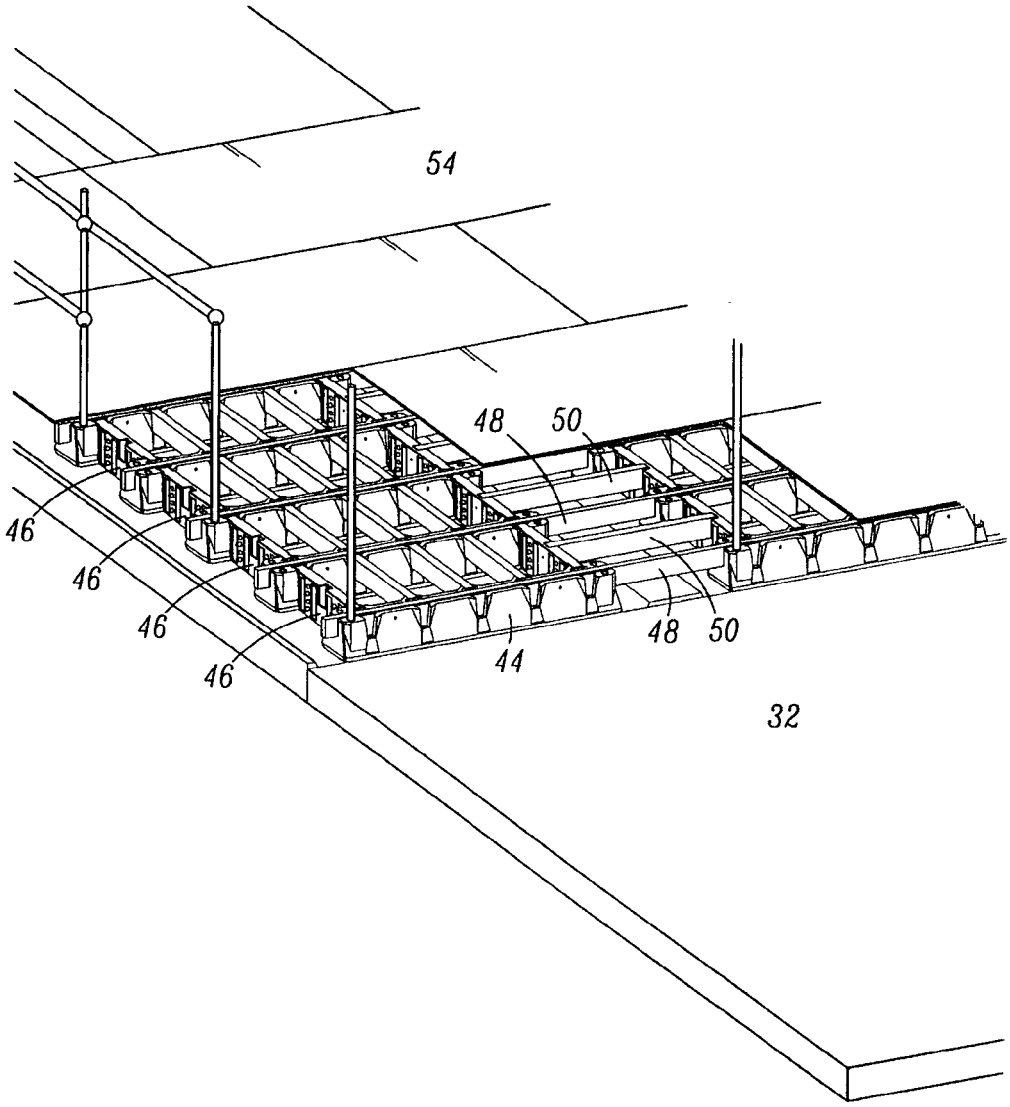

As shown most clearly in FIGS. 9 and 10, the shoulders 150 and 152 may be provided with protrusions 176 which are configured to fit into protrusions accepting apertures 110 in the pockets 98*b* and 102*b*.

From the above, it can be seen that there has been provided a unique removable platform arrangement that may be installed over a bowling alley array of bowling lanes in a bowling alley facility so that the space above the lanes may be utilized for desired activities other than bowling. The removable platform is relatively easy to install and remove, utilizes, to a large extent, components that are readily available from locations near the bowling facility to make the platform more economical to the proprietor of a bowling facility. When not in use as a platform, the components thereof may be conveniently stored.

Although specific embodiments of the present invention have been described above with reference to the various Figures of the drawing, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

The invention claimed is:

1. A platform arrangement for covering the lanes of a bowling alley array having a plurality of longitudinally extending bowling lanes in a side by side substantially parallel alignment and each lane having a first longitudinally extending edge and a second longitudinally extending edge and a bowling ball gutter extending longitudinally adjacent each edge of said bowling lanes and the gutter adjacent the first edge of each lane is separated from the gutter of the adjacent lane by a single division capping and the gutter adjacent the second edge of each lane is separated from the gutter in the adjacent lane by a bowling ball return capping comprising, in combination:

a plurality of base support members in a preselected rectilinear grid having a preselected longitudinally extending spaced array, said preselected longitudinal spaced array extending longitudinally along at least some of said bowling lanes of said bowling array, and said plurality of base support members in a substantially aligned transverse array in adjacent bowling lanes of said bowling alley array, and each of said base support members having:

a top surface and a bottom surface, said bottom surface for contact with said bowling surface of said lanes of said bowling alley array and having a first end and said first end having a first end portion thereof overhanging a part of the gutter adjacent the first edge of the lane and a second end and said second end having a second end portion thereof overhanging a part of the gutter adjacent the second edge of the lane, and said top surface spaced vertically from said bottom surface;

a front surface;

a back surface spaced longitudinally from said front surface;

said top surface of each of said base support members having first walls defining a transversely extending groove therein extending from said first end to said second end;

said front surface of each of said plurality of base support members having second walls defining a plurality of front pockets in a preselected front pocket transversely spaced array;

said back surface of each of said plurality of base support members having third walls defining a plurality of back pockets in a preselected back pocket transversely spaced array;

a plurality of transversely extending support members in said grooves of said top surfaces of said base support members;

a plurality of longitudinal support members having first ends in said front pockets of said base support members and second ends in said back pockets of said base support members;

a plurality of lane edge support members having a front surface, a back surface, a top surface and a bottom surface and, said top surface having walls defining a pocket open at said top surface and extending a preselected distance toward said back surface, and said bottom surface positionable on the bowling surface of the lane adjacent the gutter and, a planar sheet like member on said top surface of said plurality of base support members and extending over a first preselected number of said plurality of said longitudinally extending spaced array of said base support members and a second preselected number of said substantially aligned transverse array of said base support members.

2. The arrangement defined in claim 1 wherein:

said first walls of each of said transversely aligned base support members are substantially transversely aligned.

3. The arrangement defined in claim 1 wherein:

the number of said plurality of second walls in said front surface of each of said base support members is the same as the number of said third walls in said back surface of each of said base support members.

4. The arrangement defined in claim 1 wherein:

said plurality of front pockets on each of said plurality of base support members are aligned with corresponding plurality of said back pockets on each one of said plurality of base supports.

5. The arrangement defined in claim 4 wherein:

said plurality of front pockets and said plurality of back pockets on each of said plurality of base support members in said longitudinal spaced array are in longitudinal alignment with each other of said front pockets and said back pockets of each of said base support members in said longitudinal spaced array.

6. The arrangement defined in claim 5 wherein:

said first walls of each of said transversely aligned base support members are substantially transversely aligned with each other of said transversely aligned base support members in each of said bowling lanes.

7. The arrangement defined in claim 1 wherein:

each of said front pockets and each of said back pockets has an open top at said top surface of each of said base support members.

8. The arrangement defined in claim 1 wherein:

each of said front pockets and each of said back pockets have an inner wall surface, spaced apart side wall surfaces and a lower wall surface, said lower wall surface spaced intermediate said top surface and said bottom surface of said base support members.

9. The arrangement defined in claim 8 wherein:

at least some of said lower wall surfaces of said first and said second walls have depressions therein.

10. The arrangement defined in claim 9 wherein:

all of said lower wall surfaces of said first and said second walls have depressions therein.

11. The arrangement defined in claim 2 wherein:

at least some of said plurality of transverse cross members positioned in said transversely extending grooves of said plurality of base support members and said at least some of said plurality of transverse cross members bridging said bowling ball return capping.

12. A platform arrangement for covering the lanes of a bowling alley array having a plurality of longitudinally extending bowling lanes in a side by side substantially parallel alignment and each lane having a first longitudinally extending edge and a second longitudinally extending edge and a bowling ball gutter extending longitudinally adjacent each edge of said bowling lanes and the gutter adjacent the first edge of each lane is separated from the gutter of the adjacent lane by a division capping and the gutter adjacent the second edge of each lane is separated from the gutter in the adjacent lane by a bowling ball return capping comprising, in combination:

a plurality of base support members in a preselected rectilinear grid having a preselected longitudinally extending spaced array, said preselected longitudinal spaced array extending longitudinally along at least some of said bowling lanes of said bowling array, and said plurality of base support members in a substantially aligned transverse array in adjacent bowling lanes of said bowling alley array, and each of said base support members having:

a top surface and a bottom surface, said bottom surface for contact with said bowling surface of said lanes of said bowling alley array and having a first end and said first end having a first end portion thereof overhanging a part of the gutter adjacent the first edge of the lane and a second end and said second end having a second end portion thereof overhanging a part of the gutter adjacent the second edge of the lane, and said first end portion and said second end portion free of contact with any portion of the bowling alley array and said top surface spaced vertically from said bottom surface;

a front wall having a front surface;

a back wall having a back surface spaced longitudinally from said front surface;

said top surface of each of said base support members having first walls defining a transversely extending groove therein extending from said first end to said second end;

said front surface of each of said plurality of base support members having second walls defining a plurality of front pockets in a preselected front pocket transversely spaced array;

said back surface of each of said plurality of base support members having third walls defining a plurality of back pockets in a preselected back pocket transversely spaced array;

said plurality of front pockets and said plurality of back pockets on each of said plurality of base support members in said transversely spaced array are in longitudinal alignment with each other of said front pockets and said back pockets of each of said base support members in said longitudinal spaced array;

a plurality of transverse support members in said transversely extending grooves in said top surface of said base support members and extending between transversely aligned base support members, and said plurality of transverse support members having a top surface substantially coplanar with said top surface of said base support members and a bottom surface free of contact with any portion of said bowling alley array;

a plurality of longitudinal support members each of said longitudinal support members having a first end in one said front pockets in one of said base support members a second end in said back pocket of the next of said longitudinally spaced base support member, and each of said longitudinal support members having a top surface substantially coplanar with said top surface of sad base support member and a bottom surface free of contact with any portion of said bowling alley array;

a plurality of lane edge longitudinal support members mounted on said base support members adjacent the edges of the lanes having a first end in one said front pockets in one of said base support members a second end in said back pocket of the next of said longitudinally spaced base support member and having a top surface and a bottom surface, said top surface substantially coplanar with said top surface of said base support members and said bottom surface for engagement with the bowling surface of the lanes;

a planar sheet like member on said top surface of said plurality of base support members and extending over a first preselected number of said plurality of said longitudinally extending spaced array of said base support members and a second preselected number of said substantially aligned transverse array of said base support members.

13. The arrangement defined in claim 12 and further comprising:

said top surface of said lane edge longitudinal support members have walls defining a pocket therein and said pocket extending from said front surface toward said back surface;

said lane edge longitudinal support members having aligned front surfaces thereof facing each other in adjacent lanes on opposite sides of said ball return cover capping and said single division capping.

14. The arrangement defined in claim 13 and further comprising:

auxiliary transverse support members positionable in said pockets of said lane edge longitudinal support members and bridging said ball return cover capping and said single division capping.

15. The arrangement defined in claim 11 wherein:

said transverse support members bridge said gutters and said single division capping and are spaced vertically above and free of contact with said gutters, said single division capping and said ball return capping, whereby the weight of the platform is supported on the bowling lanes of the bowling alley array.

16. The arrangement defined in claim 11 wherein:

said auxiliary transverse support members bridge said gutters, said single division capping and said ball return capping are spaced vertically above and free of contact with said gutters, said single division capping and said ball return capping, whereby the weight of the platform is supported on the bowling lanes of the bowling alley array.

17. The arrangement defined in claim 11 wherein:

said plurality of lane edge support members have bottom surfaces, and said bottom surfaces of said base support members and said lane edge support members are in contact with said bowling lanes of said bowling alley array to support the weight of the platform arrangement only thereon.

18. The arrangement defined in claim 16 wherein:

said plurality of lane edge support members have bottom surfaces, and said bottom surfaces of said base support members and said lane edge support members are in contact with said bowling lanes of said bowling alley array to support the weight of the platform arrangement only thereon.

* * * * *